US007185509B2

(12) United States Patent
Lee et al.

(10) Patent No.: US 7,185,509 B2
(45) **Date of Patent: *Mar. 6, 2007**

(54) REFRIGERATOR

(75) Inventors: Jae Seung Lee, Kwangju (KR); Myung Wouk Kim, Kwangju (KR); Gi Joong Jeong, Kwangju (KR); Jong Dal Lee, Suwon (KR); Ji Sick Hwang, Yangsan (KR); Sang Gyu Jung, Kwangju (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 299 days.

This patent is subject to a terminal disclaimer.

(21) Appl. No.: 10/644,937

(22) Filed: Aug. 21, 2003

(65) Prior Publication Data

US 2004/0040338 A1 Mar. 4, 2004

(30) Foreign Application Priority Data

Aug. 31, 2002 (KR) ..... 10-2002-0052256
Mar. 28, 2003 (KR) ..... 10-2003-0019481

(51) Int. Cl.
*F25D 17/06* (2006.01)
*F25D 11/02* (2006.01)
*F25D 19/02* (2006.01)

(52) U.S. Cl. ..... 62/419; 62/441; 62/448

(58) Field of Classification Search ..... 62/441, 62/298, 419, 448, 454
See application file for complete search history.

(56) References Cited

U.S. PATENT DOCUMENTS 1,543,349 A 6/1925 Walker
1,685,248 A 9/1928 Strufe
1,761,040 A 6/1930 Hull
1,780,425 A 11/1930 Hull
2,450,844 A 10/1948 Stuart
2,812,642 A 11/1957 Jacobs
2,815,649 A 12/1957 Di Angelus et al.
3,122,899 A * 3/1964 Costantini et al. ..... 62/419

(Continued)

FOREIGN PATENT DOCUMENTS

| | | |
|---|---|---|
| CA | 633899 | 1/1962 |
| CH | 435 339 | 5/1967 |
| DE | 1237148 | 3/1967 |
| EP | 0361307 | 4/1990 |
| EP | 0382963 | 8/1990 |

(Continued)

OTHER PUBLICATIONS

U.S. Appl. No. 10/644,961, filed Aug. 21, 2003, Lee et al., Samsung Electronics Co., Ltd.

(Continued)

*Primary Examiner*—William C. Doerrier
(74) *Attorney, Agent, or Firm*—Staas & Halsey LLP

(57) ABSTRACT

A refrigerator in which a machine room and an air cooling chamber having an evaporator, are placed at a top of a cabinet to maximize the storage capacity of lower sections of storage compartments. The refrigerator includes a cabinet defining a storage compartment therein. A top projection part is formed by projecting a rear portion of a top of the cabinet upward. The top projection part defines the air cooling chamber therein, such that the air cooling chamber extends upward from an upper portion of the storage compartment. The machine room is defined on the top of the cabinet at a position in front of the top projection part, and receives a compressor and a condenser therein.

41 Claims, 5 Drawing Sheets

U.S. PATENT DOCUMENTS 3,126,716 A 3/1964 Witte
3,178,902 A * 4/1965 Costantini et al. ..... 62/237
3,353,314 A * 11/1967 Melcher ..... 52/127.9
3,405,987 A 10/1968 Pulaski
3,489,477 A 1/1970 Harder, Jr.
3,590,594 A 7/1971 Arend
3,620,404 A 11/1971 Grasso
3,712,078 A * 1/1973 Maynard et al. ..... 62/448
3,745,786 A 7/1973 Laughlin et al.
3,834,176 A 9/1974 Clarke
3,835,660 A 9/1974 Franck
3,893,307 A 7/1975 Jacobs
3,984,223 A 10/1976 Whistler, Jr.
3,992,171 A 11/1976 Jenewein
4,076,350 A 2/1978 Crist
4,638,644 A 1/1987 Gidseg
4,714,304 A 12/1987 Sisk et al.
4,741,175 A 5/1988 Schulze
4,776,182 A * 10/1988 Gidseg ..... 62/448
4,822,117 A 4/1989 Boston, Jr.
4,970,874 A 11/1990 Solak et al.
5,086,627 A 2/1992 Borgen
5,212,924 A * 5/1993 Finkelstein ..... 52/582.2
5,284,023 A * 2/1994 Silva et al. ..... 62/77
5,368,381 A 11/1994 Mandel
5,531,267 A 7/1996 Ahmed et al.
5,564,808 A 10/1996 Gipson et al.
5,584,551 A 12/1996 Jenkins
5,729,997 A 3/1998 Witsoe
5,730,516 A 3/1998 Vismara
5,826,442 A 10/1998 Lee
5,908,229 A 6/1999 Wetherholt et al.
6,029,411 A 2/2000 Richardson
6,036,294 A 3/2000 Banicevic et al.
6,056,383 A 5/2000 Banicevic et al.
6,070,424 A * 6/2000 Bauman et al. ..... 62/279
6,094,934 A 8/2000 Rand et al.
6,122,879 A * 9/2000 Montes ..... 52/592.1
6,216,410 B1 * 4/2001 Haberman ..... 52/591.1
6,341,830 B1 1/2002 Chun
6,381,981 B1 5/2002 Yaddgo et al.
6,464,312 B1 10/2002 Tenhundfeld
6,735,976 B2 * 5/2004 Lee ..... 62/419
2002/0093276 A1 * 7/2002 Kawakami ..... 312/405
2002/0117949 A1 8/2002 Banicevic et al.
2004/0040338 A1 3/2004 Lee et al.
2004/0041503 A1 3/2004 Lee
2004/0139763 A1 7/2004 Jeong et al.
2004/0144130 A1 7/2004 Jung
2004/0163408 A1 8/2004 Kim et al.

FOREIGN PATENT DOCUMENTS

EP 1079187 2/2001
EP 1 174 666 A2 1/2002
EP 1174666 * 1/2002
GB 850555 10/1960
JP 54-68557 6/1979
KR 1999-019291 3/1999
KR 10-0288258 2/2001
WO 93/08434 4/1993

OTHER PUBLICATIONS

U.S. Appl. No. 10/687,673, filed Oct. 20, 2003, Jeong et al., Samsung Electronics Co., Ltd.
U.S. Appl. No. 10/385,566, Mar. 12, 2003, Lee, Samsung Electronics Co., Ltd.
Patent Abstracts of Japan for Japanese Application Publication No. 2000-65459, published Mar. 3, 2000.
European Search Report dated May 11, 2004 issued in European Application No. 03025146.6-2301-.

* cited by examiner

REFRIGERATOR

CROSS-REFERENCE TO RELATED APPLICATIONS

This application claims the benefit of Korean Application No. 2002-52256, filed Aug. 31, 2002 and Korean Application No. 2003-19481, filed on Mar. 28, 2003, in the Korean Intellectual Property Office, the disclosures of which are incorporated herein by reference.

BACKGROUND OF THE INVENTION

1. Field of the Invention

The present invention relates, in general, to refrigerators and, more particularly, to a refrigerator in which both a machine room and air cooling chambers, each having an evaporator, are placed at a top of a cabinet to enlarge storage space in the refrigerator.

2. Description of the Related Art

As is well known to those skilled in the art, a refrigerator is a machine that generates cool air with an evaporator and supplies the cool air into a storage compartment inside a cabinet, thus maintaining freshness of stored food for a desired lengthy period of time. In accordance with the recent trend of consumers preferring refrigerators having large storage capacities to small capacity refrigerators, the storage capacity of refrigerators has become increasingly large. An example of a refrigerator with a large storage capacity is a side-by-side style refrigerator, which is designed to place a refrigerator compartment and a freezer compartment side-by-side with each other, in consideration of food storage efficiency, food freshness-keeping efficiency, and a user's convenience while putting food in and taking food out of the two compartments.

In a conventional side-by-side style refrigerator, two storage compartments are placed side by side to form a refrigerator compartment and a freezer compartment, respectively. A refrigerator compartment door is hinged to an open front of the refrigerator compartment, and a freezer compartment door is hinged to an open front of the freezer compartment, so that the two compartments are independently closed and opened by the two doors. A plurality of racks and storage containers are provided on an inner surface of each of the two doors to increase the storage capacity of the refrigerator and freezer compartments. To supply cool air into the refrigerator compartment and the freezer compartment, each of the two compartments is provided, at an inner rear wall thereof, with an evaporator, a cool air circulation fan, and an air duct, forming an air path. A plurality of air suction ports and a plurality of air exhaust ports are formed at a front surface of the air duct. Defined at a rear portion of a lower section of the cabinet is a machine room which receives a condenser, a compressor, a cooling fan, etc.

But the conventional side-by-side style refrigerator is problematic. That is, in the side-by-side style refrigerator, the evaporator that produces cool air, and the cool air circulation fan that circulates the cool air, are provided at the rear portion of each of the refrigerator compartment and the freezer compartment. In addition, the machine room that receives the condenser, the compressor, the cooling fan, etc., is defined at the rear portion of the lower section of the cabinet. The conventional side-by-side style refrigerator thus undesirably reduces the storage capacity of both the refrigerator compartment and the freezer compartment.

Furthermore, conventional large capacity refrigerators, such as side-by-side style refrigerators, are tall, so that diminutive users typically prefer lower sections of the storage compartments to higher sections, when storing food in the compartments. But, as previously noted, the machine room is defined at the rear portion of the lower section of the cabinet, thus consuming lower spaces of the storage compartments, and reducing the storage capacity of the lower sections of the storage compartments, which are preferred by the diminutive users.

SUMMARY OF THE INVENTION

Accordingly, it is an aspect of the present invention to provide a refrigerator in which air cooling chambers, each having an evaporator, and a machine room are placed at a top of a cabinet to maximize the storage capacity of lower sections of storage compartments.

Additional aspects and advantages of the invention will be set forth in part in the description which follows and, in part, will be obvious from the description, or may be learned by practice of the invention.

The foregoing and/or other aspects of the present invention are achieved by providing a refrigerator, having a cabinet defining a storage compartment therein, a top projection part formed by projecting a rear portion of a top of the cabinet upward, the top projection part defining an air cooling chamber therein, such that the air cooling chamber extends upward from an upper portion of the storage compartment, and a machine room, that is located on the top of the cabinet at a position in front of the top projection part, and has a compressor and a condenser therein.

According to one aspect, the air cooling chamber has an evaporator to produce cool air, and a cool air circulation fan to circulate the cool air.

According to one aspect, the air cooling chamber has an air path partition plate that is spaced apart from an upper surface of the air cooling chamber, and partitions the air cooling chamber into a front space part and a rear space part, with the evaporator and the cool air circulation fan installed in the rear space part.

According to one aspect, the cool air circulation fan is installed above the evaporator to blow the cool air, produced by the evaporator, into the front space part. According to one aspect, the cool air circulation fan is a cross flow fan.

According to one aspect, the refrigerator also has an air suction guide member mounted to a rear surface of the storage compartment that is spaced apart from the rear surface of the storage compartment, thereby defining an air path to guide air from the storage compartment into the rear space part of the air cooling chamber. The air suction guide member has a plurality of air suction ports. Additionally, the refrigerator has an air exhaust guide member mounted to an upper surface of the storage compartment that is spaced apart from the upper surface of the storage compartment, and has a plurality of air exhaust ports. The air exhaust guide uniformly discharges the cool air from the front space part of the air cooling chamber into the storage compartment.

According to one aspect, the machine room has a machine room casing, which has a housing mounted to the top of the cabinet to cover an upper surface and both side surfaces of the machine room, and a cover member hinged to the housing to open and close a front of the housing. The cover member has a plurality of vent holes.

According to one aspect machine room also has a cooling fan to cool the compressor and the condenser.

The foregoing and/or other aspects of the present invention are also achieved by providing a refrigerator, with: a cabinet defining a freezer compartment and a refrigerator compartment therein, such that the freezer and refrigerator compartments are placed side-by-side with each other in the cabinet and partitioned from each other; a top projection part formed by projecting a rear portion of a top of the cabinet upward, the top projection part defining a first air cooling chamber for the freezer compartment and a second air cooling chamber for the refrigerator compartment therein such that the first and second air cooling chambers extend upward from upper portions of the freezer and refrigerator compartments, respectively; and a machine room defined on the top of the cabinet at a position in front of the top projection part, and having a compressor and a condenser therein.

According to one aspect, each of the first and second air cooling chambers for the freezer and refrigerator compartments has an evaporator and a cool air circulation fan.

According to another aspect, each of the first and second air cooling chambers for the freezer and refrigerator compartments is partitioned into a front space part and a rear space part by an air path partition plate, with the evaporator being installed in the rear space part of each of the first and second air cooling chambers. According to yet another aspect, the cool air circulation fan is a cross flow fan which longitudinally extends in each of the first and second air cooling chambers at a position above the evaporator.

According to one aspect, the cabinet has an inner casing, an outer casing, and a thermal insulation material interposed between the inner and outer casings. According to another aspect, the inner casing has two integrated bodies that define the freezer compartment and the refrigerator compartment, respectively.

According to one aspect, the outer casing has: two side panels that form two side surfaces of the cabinet; two rear panels assembled with each other, and assembled with the two side panels, thus forming a rear surface of the cabinet; a top panel to form a top surface of the cabinet; and a bottom panel to form a bottom surface of the cabinet.

According to one aspect, first and second locking parts are formed along facing edges of each of the two side panels and the two rear panels. Each first locking part has a longitudinal groove, and each second locking part is formed as a longitudinal projection that locks in the longitudinal groove of the corresponding first locking part.

According to one aspect, a grooved reinforcing part is longitudinally formed along at least one of the two rear panels, thereby reinforcing the rear panels.

According to one aspect, the top panel is stepped to form the top projection part.

According to one aspect, the inner casing has two chamber casings. The two chamber casings are produced separately from the two integrated bodies, and are installed at the rear portion of the top of the cabinet, such that the two chamber casings are respectively positioned above the freezer and refrigerator compartments, to define the first and second air cooling chambers.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE PREFERRED EMBODIMENTS

Figure 1:
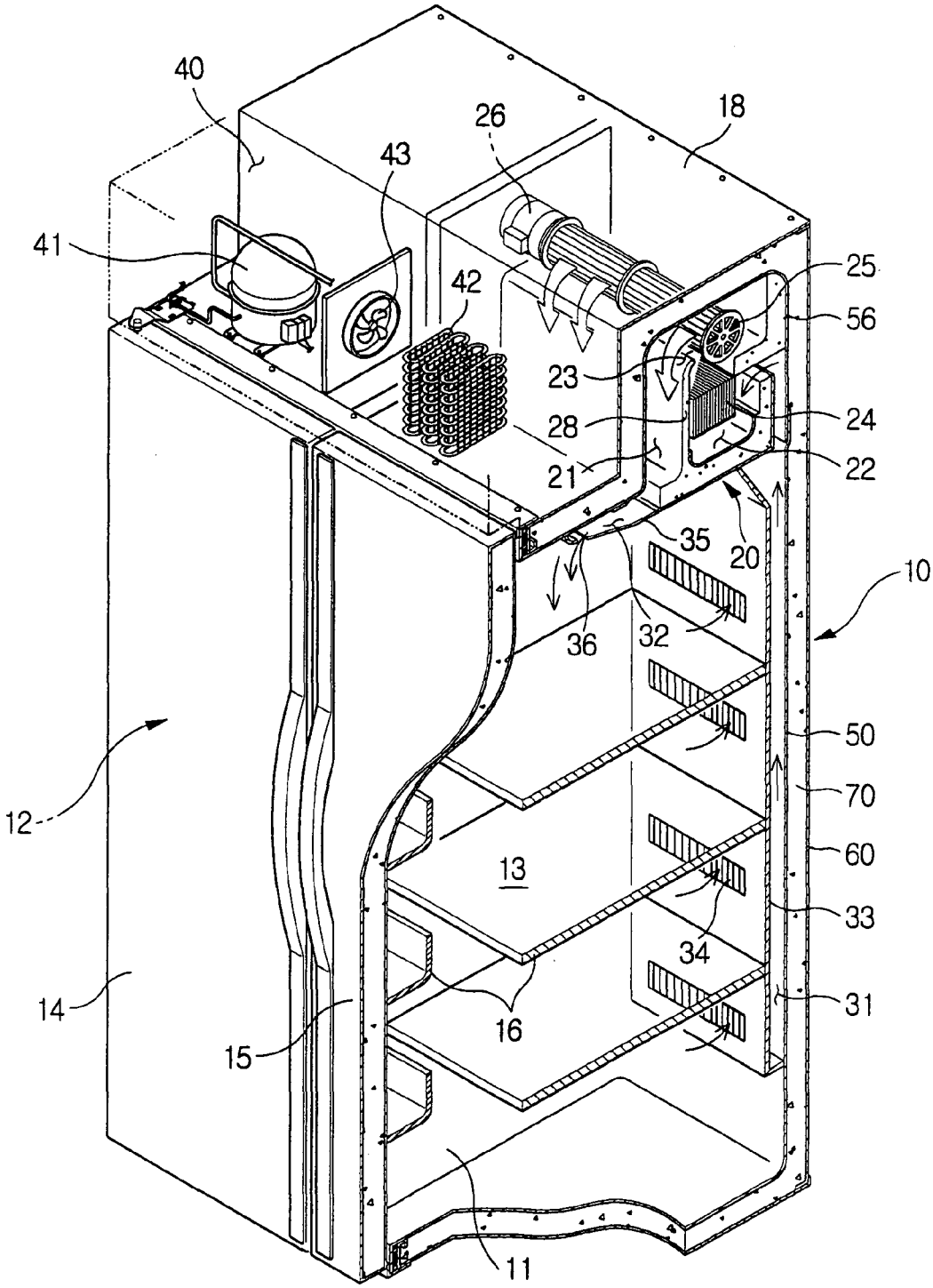
FIG. 1 is a partially broken perspective view showing a construction of a refrigerator, according to an embodiment of the present invention.

Reference will now be made in detail to the embodiments of the present invention, examples of which are illustrated in the accompanying drawings, wherein like reference numerals refer to like elements throughout. The embodiments are described below to explain the present invention by referring to the figures.

FIG. 1 is a partially broken perspective view showing a construction of a refrigerator, according to an embodiment of the present invention. As shown in the drawing, a storage compartment defined in a cabinet 10 of the refrigerator according to the present invention is partitioned by an intermediate partition wall 11 into left and right compartments. The left compartment forms a freezer compartment 12, while the right compartment forms a refrigerator compartment 13. A freezer compartment door 14 is hinged to an open front of the freezer compartment 12, and a refrigerator compartment door 15 is hinged to an open front of the refrigerator compartment 13, so that the two compartments 12 and 13 are closed and opened by the two doors 14 and 15, independently. A plurality of racks 16 are installed in each of the two compartments 12 and 13, and on an inner surface of each of the two doors 14 and 15 to store food in the two compartments 12 and 13.

A top of the cabinet 10 projects upward at a rear portion thereof to form a top projection part 18. The top projection part 18 defines two air cooling chambers 20 therein to receive an evaporator 24 and a cool air circulation fan 25 in each of the two air cooling chambers 20. Due to the top projection part 18, the upper sections of the freezer and refrigerator compartments 12 and 13 extend upward along rear portions thereof to produce the two air cooling chambers 20, such that the two air cooling chambers 20 are horizontally and longitudinally located along the rear portions of the upper sections of the freezer and refrigerator compartments 12 and 13, respectively. The top projection part 18 is integrated with the cabinet 10, and has a wall made of a thermal insulation material in the same manner as the cabinet 10 to thermally insulate the air cooling chambers 20 from the atmosphere. The two air cooling chambers 20 communicate at lower portions thereof with the freezer and refrigerator compartments 12 and 13, respectively.

A machine room 40 is defined on the top of the cabinet 10 at a position in front of the two air cooling chambers 20, and receives a compressor 41, a condenser 42, and a cooling fan 43 therein. Since the machine room 40 is placed at the top of the cabinet 10, the refrigerator of the present invention enlarges storage spaces of the lower sections of the freezer and refrigerator compartments 12 and 13.

Figure 2:
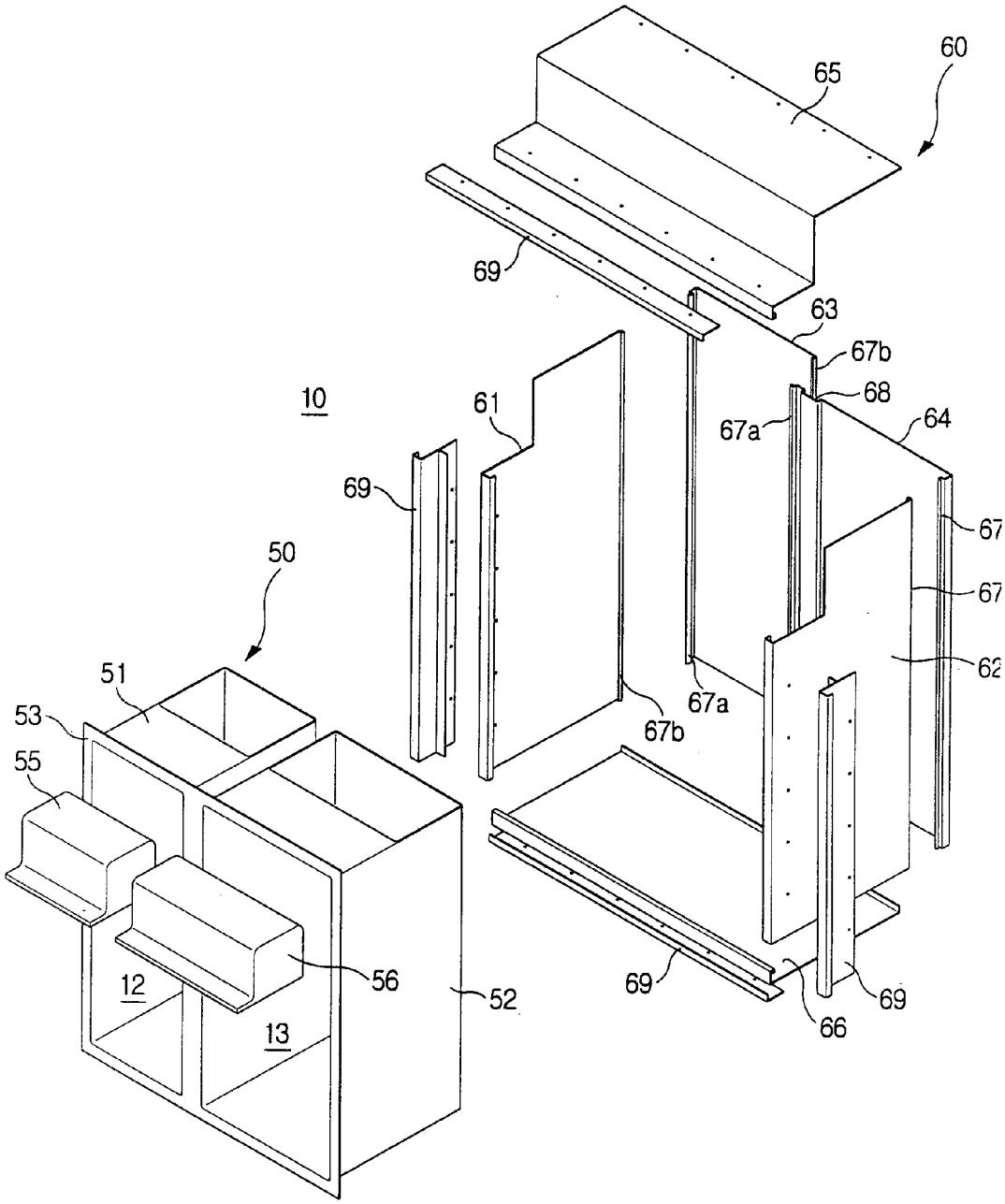
FIG. 2 is an exploded perspective view showing a structure of inner and outer casings constituting a cabinet of the refrigerator of FIG. 1.
Figure 3:
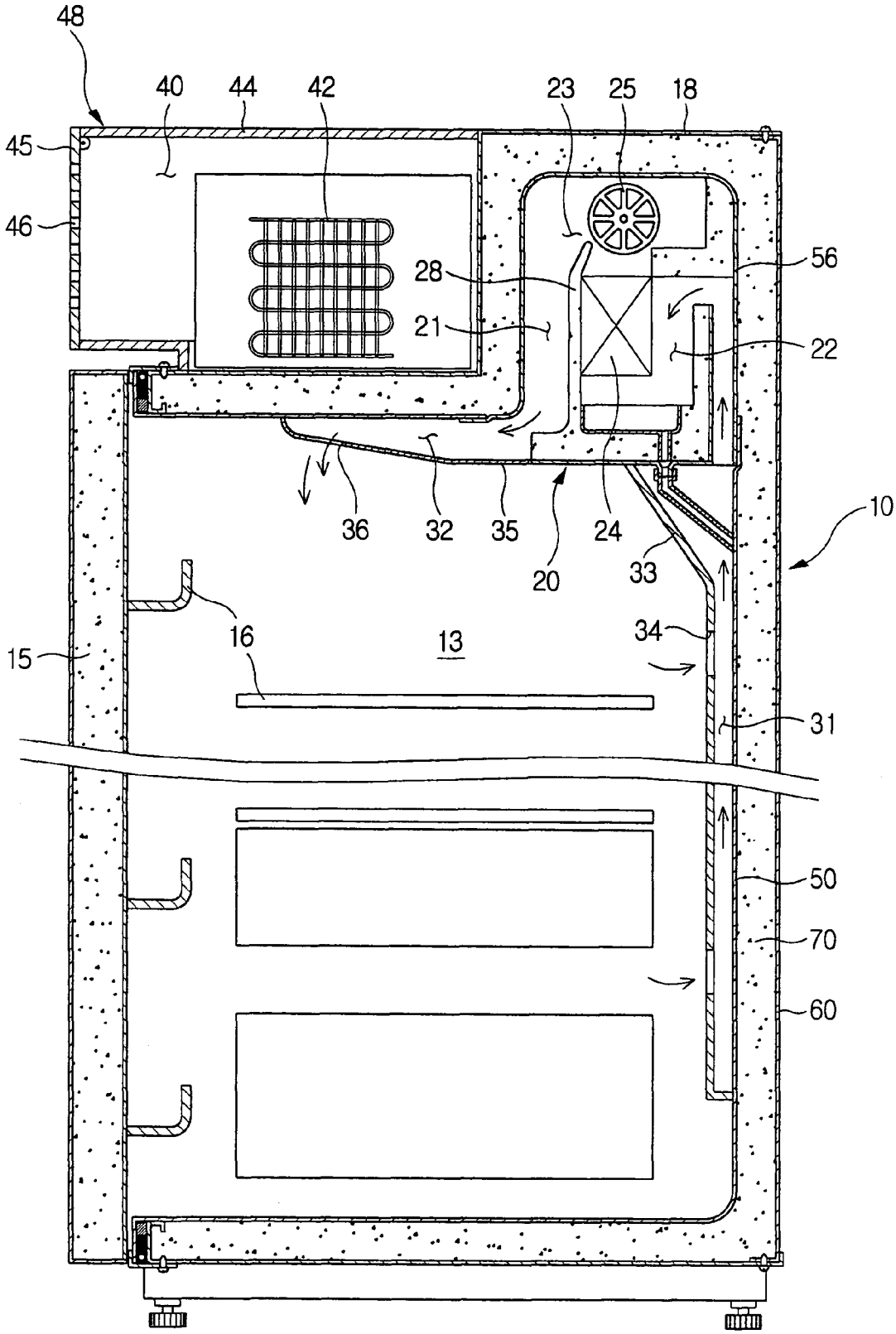
FIG. 3 is a longitudinal sectioned view showing a construction of a refrigerator compartment of the refrigerator of FIG. 1.

The cabinet 10 of the refrigerator has a thermal insulation wall, which is fabricated with a thermal insulation foam 70 closely interposed between inner and outer casings 50 and 60, as shown in FIG. 3. The inner casing 50 which defines the freezer and refrigerator compartments 12 and 13 therein, includes a first inner casing part 51 defining the freezer compartment 12, and a second inner casing part 52 defining the refrigerator compartment 13, as shown in FIG. 2. The inner casing 50 is formed as a single body through a molding process, such that the first and second inner casing parts 51 and 52 are integrated into a single structure. The inner casing 50 is open at the front thereof to form two openings, with a flange 53 integrally formed along an edge of the open front of the inner casing 50. Since the inner casing 50 has the integrated structure, it is possible to reduce the number of elements and the production cost of the cabinet 10. The flange 53 of the inner casing 50 accomplishes a pleasant front appearance of the cabinet 10.

Figure 4:
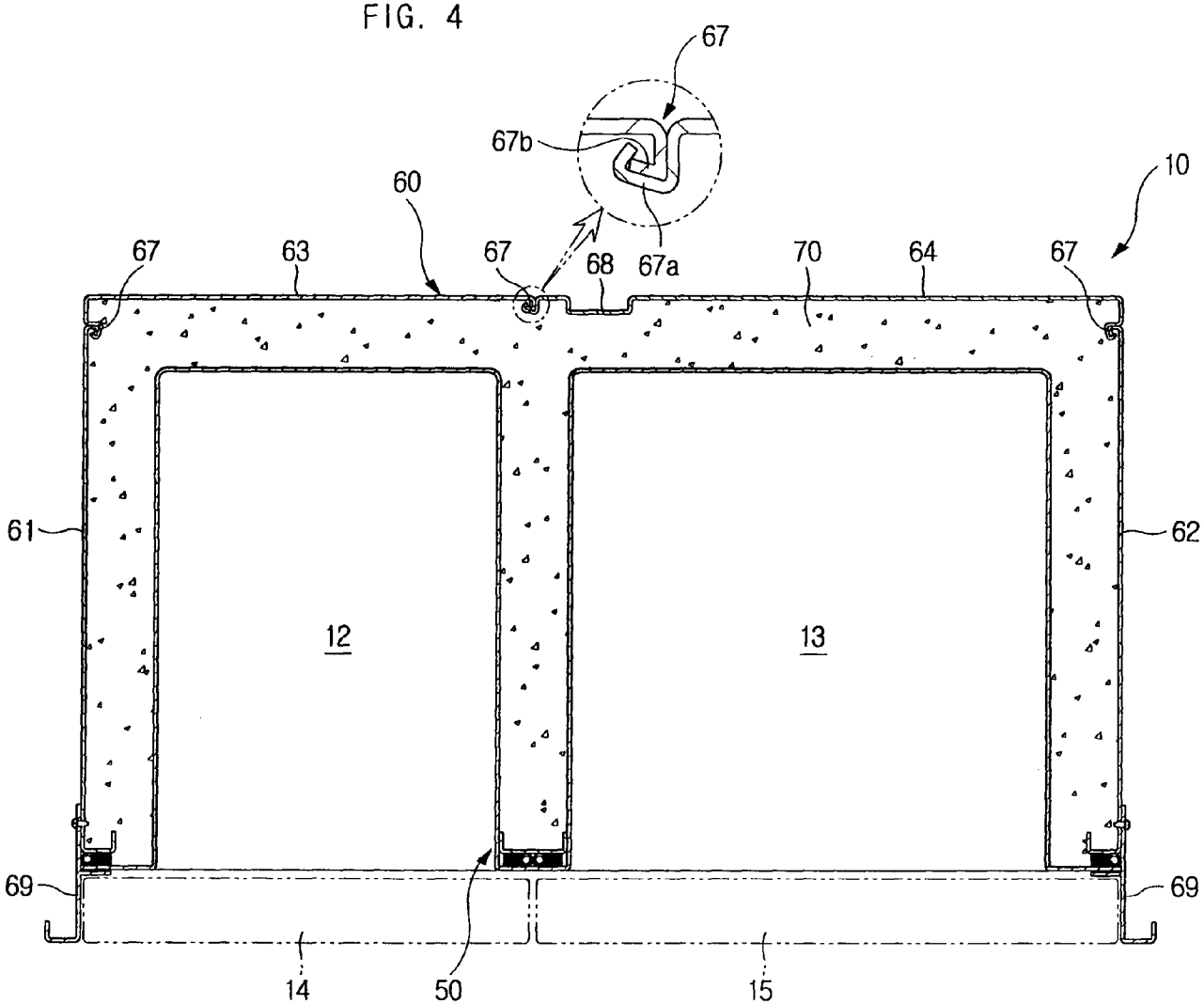
FIG. 4 is a latitudinal sectioned view of the refrigerator of FIG. 1.

The outer casing 60, forming an external surface of the cabinet 10, is fabricated by assembling two side panels 61 and 62, two rear panels 63 and 64, a top panel 65, and a bottom panel 66 into a single structure, as shown in FIGS. 2 and 4. The two side panels 61 and 62 form two side surfaces of the cabinet 10, the two rear panels 63 and 64 form a rear surface of the cabinet 10, the top panel 65 forms a top surface of the cabinet 10, and the bottom panel 66 forms a bottom surface of the cabinet 10. First and second locking parts 67*a* and 67*b* are formed along facing edges of each of two locked junctions 67 between rear edges of the two side panels 61 and 62 and outside edges of the two rear panels 63 and 64, and a locked junction 67 between inside edges of the two rear panels 63 and 64.

The first locking part 67*a* is formed along one facing edge while being bent to form a longitudinal groove, and the second locking part 67*b* is formed along the other facing edge while being bent to form a longitudinal projection which is locked in the groove of the first locking part 67*a*. Due to the first and second locking parts 67*a* and 67*b*, the two side panels 61 and 62 and the two rear panels 63 and 64 are easily assembled with each other during a process of assembling the outer casing 60, and the inner and outer casings 50 and 60 are tightly assembled with each other while accomplishing a sealing effect, with the thermal insulation foam 70 closely interposed between the inner and outer casings 50 and 60. A grooved reinforcing part 68 is longitudinally formed along at least one of the two facing edges of the rear panels 63 and 64 forming the rear surface of the cabinet 10, thereby reinforcing the strength of the rear surface of the cabinet 10. According to one aspect, as shown in the drawings, the grooved reinforcing part 68 is longitudinally formed along the edge of the rear panel 64.

The top panel 65 is stepped to form the top projection part 18. The top and bottom panels 65 and 66 are assembled with the two side panels 61 and 62, and the two rear panels 63 and 64 by use of a plurality of setscrews. A plurality of finishing members 69, each having a predetermined width, are mounted along a junction of the flange 53 of the inner casing 50, and the front edge of the outer casing 60, to assemble the inner and outer casings 50 and 60 with each other, and, at the same time, provide a pleasant front appearance of the refrigerator.

As shown in FIGS. 2 and 3, the two air cooling chambers 20, defined in the top projection part 18 provided at the rear portion of the top of the cabinet 10, are formed by two chamber casings 55 and 56. According to one aspect, the two chamber casings 55 and 56 are produced separately from the inner casing 50, and are installed at the rear portion of the top of the cabinet 10, and placed side-by-side with each other, such that the two chamber casings 55 and 56 are respectively positioned above the freezer and refrigerator compartments 12 and 13. According to another aspect, the two chamber casings 55 and 56 are integrally formed with the inner casing 50. But when the two chamber casings 55 and 56 are produced separately from the inner casing 50, prior to being installed on the inner casing 50, production of the inner casing 50 is simplified.

In the refrigerator of the present invention, the two air cooling chambers 20 provided above the freezer and refrigerator compartments 12 and 13 have the same construction, and so the construction of the air cooling chamber 20 provided above the refrigerator compartment 13 will be described as an example herein below, for ease of description.

As shown in FIGS. 1 and 3, an air path partition plate 28 is provided in the air cooling chamber 20 to partition the interior of the air cooling chamber 20 into a front space part 21 and a rear space part 22. The air path partition plate 28 is spaced apart from an upper surface of the air cooling chamber 20 by a predetermined gap, thus forming a communication path 23, through which the front and rear space parts 21 and 22 communicate with each other. The evaporator 24 is installed in the rear space part 22 to produce cool air, and the cool air circulation fan 25 is installed above the evaporator 24.

According to one aspect, the cool air circulation fan 25 is a cross flow fan which horizontally and longitudinally extends in the air cooling chamber 20 to have a length almost equal to a length of the air cooling chamber 20, and is placed close to an upper edge of the air path partition plate 28. A drive motor 26 is connected to an end of the cross flow fan 25. The cross flow fan 25 blows air from the rear space part 22 having the evaporator 24 into the front space part 21. In addition, the cross flow fan 25 smoothly circulates the cool air through a whole area of the communication path 23.

An air suction path 31 is provided at a rear portion of the refrigerator compartment 13 to allow the air to flow from the refrigerator compartment 13 into the rear space part 22 when the cool air circulation fan 25 is operated. An air exhaust path 32 is provided at an upper portion of the refrigerator compartment 13 to uniformly discharge the cool air from the air cooling chamber 20 into the upper portion of the refrigerator compartment 13. A panel-type air suction guide member 33 is vertically installed along a rear surface of the refrigerator compartment 13, thereby defining the air suction patch 31 as a longitudinal channel between the air suction guide member 33 and the rear surface of the refrigerator compartment 13. There are a plurality of air suction ports 34 on a front surface of the air suction guide member 33.

A panel-type air exhaust guide member 35 is mounted to an upper surface of the refrigerator compartment 13, spaced apart from the upper surface of the refrigerator compartment 13, to define the air exhaust path 32. A plurality of air exhaust ports 36 are located on a surface of the air exhaust guide member 35. In the refrigerator of the present invention, the freezer compartment 12 has a similar air path structure as that of the refrigerator compartment 13, Thus the air path structure of the freezer compartment 12 is omitted from the description.

Figure 5:
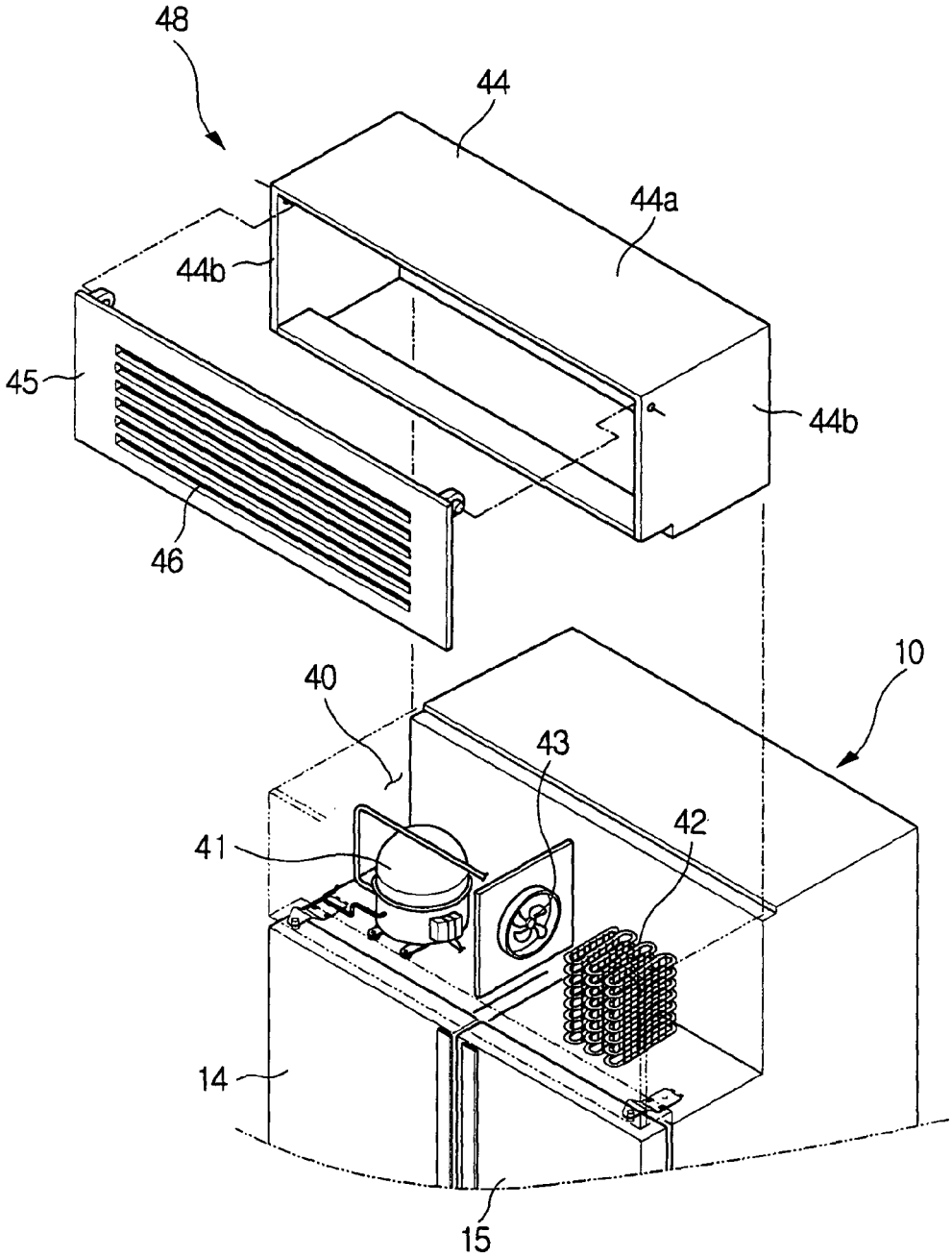
FIG. 5 is an exploded perspective view showing a construction of a machine room included in the refrigerator of FIG. 1.

As shown in FIG. 5, the machine room 40 is defined by a machine room casing 48 which is installed at the top of the cabinet 10. The machine room casing 48 includes a housing 44 and a cover member 45. The housing 44 of the machine room casing 48 has an upper wall part 44*a* and two sidewall parts 44*b* which are integrated into a single structure. The housing 44 is mounted to the cabinet 10 at a rear edge of the upper wall part 44*a* and at lower edges of the two sidewall parts 44*b*, so that the housing 44 is open at a front thereof. The cover member 45 is hinged at upper corners thereof to the housing 44 to open or close the open front of the housing 44. The cover member 45 is provided with a plurality of vent holes 46 to allow air to circulate through the vent holes 46. The compressor 41 and the condenser 42 are installed in opposite sides of the machine room 40, with the cooling fan 43 provided at an intermediate position between the compressor 41 and the condenser 42 to cool the compressor 41 and the condenser 42.

The refrigerator of the present invention operates as follows to circulate air in the refrigerator compartment 13. When the cool air circulation fan 25 installed in the air cooling chamber 20 is operated, as shown in FIG. 3, the air of the refrigerator compartment 13 is sucked into the air suction path 31 through the air suction ports 34 of the air suction guide member 33 provided at the rear portion of the refrigerator compartment 13. The sucked air passes through the evaporator 24 installed in the rear space part 22 of the air cooling chamber 20 and becomes cool air. The cool air passes through the front space part 21 of the air cooling chamber 20, and discharges into the refrigerator compartment 13 through the air exhaust path 32, due to a blowing force of the cool air circulation fan 25. The cool air is discharged into the refrigerator compartment 13 through the air exhaust ports 36 provided at the whole area of the upper portion of the refrigerator compartment 13 in a showering manner, and the cool air is smoothly circulated.

According to one aspect, the air cooling chambers 20 are horizontally placed at the top of the cabinet 10, and the cool air circulation fans 25 installed in the air cooling chambers 20 are cross flow fans. Therefore, the cross-sectional area of the air path is not rapidly or remarkably changed when the air flows through the air path, so that the air path is less likely to produce flow resistance. That is, the air flows through the air path in a laminar flow manner, so that the air smoothly flows in the air path, with minimal flow resistance. The cooling efficiency of the refrigerator compartment 13 is thus improved. A cool air circulation in the freezer compartment 12 is similar to that described for the refrigerator compartment 13, and further explanation is thus not deemed necessary.

As is apparent from the above description, the present invention provides a refrigerator in which air cooling chambers, each having an evaporator, are placed at a rear portion of a top of a cabinet, and a machine room is placed at a front portion of the top of the cabinet, thus maximizing the storage capacity of lower sections of storage compartments.

In addition, the air cooling chambers are horizontally placed at the top of the cabinet, and cool air circulation fans installed in the air cooling chambers are cross flow fans, so that the refrigerator minimizes a flow resistance of an air path, thus improving the cool air circulation efficiency, and thereby improving the cooling efficiency of the storage compartments.

Furthermore, since the machine room is placed at the front portion of the top of the cabinet, atmospheric air is smoothly circulated into the machine room, thus effectively cooling the interior of the machine room, even if the refrigerator is installed between walls of a building or between furniture.

Although an embodiment of the present invention has been shown and described, it would be appreciated by those skilled in the art that changes may be made in this embodiment without departing from the principles and spirit of the invention, the scope of which is defined in the claims and their equivalents.

What is claimed is:

1. A refrigerator, comprising:

a cabinet defining a food storage compartment therein;

a top projection part formed by projecting a rear portion of a top of the food storage compartment upward, the top projection part defining an air cooling chamber therein such that the air cooling chamber extends upward as an upper portion of the food storage compartment, wherein the air cooling chamber comprises an air path partition plate that is spaced apart from an upper surface of the air cooling chamber, and partitions the air cooling chamber into a front space part and a rear space part;

an evaporator, located in the air cooling chamber of the food storage compartment, to produce cool air;

a cool air circulation fan, located in the air cooling chamber of the food storage compartment, to circulate the cool air;

a machine room located on top of the cabinet at a position in front of the top projection part, and receiving a compressor and a condenser therein;

an air suction guide member, mounted to a rear surface of the storage compartment and spaced apart from the rear surface of the storage compartment, thereby defining an air suction path to guide air from the storage compartment into the rear space part of the air cooling chamber, and having a plurality of air suction ports; and an air exhaust guide member mounted to an upper surface of the storage compartment and spaced apart from the upper surface of the storage compartment, thereby defining an air exhaust path, and having a plurality of air exhaust ports to discharge the cool air from the front space part of the air cooling chamber along the air exhaust path into the storage compartment, wherein the cool air circulation fan longitudinally extends in the air cooling chamber, and the air suction path and the air exhaust path extend laterally along the entire length of the refrigerator parallel to the rear surface of the storage compartment and to communicate with the air cooling chamber.

2. The refrigerator according to claim 1, wherein the evaporator and the cool air circulation fan are installed in the rear space part.

3. The refrigerator according to claim 2, wherein:

the cool air circulation fan is installed about the evaporator to blow the cool air, produced by the evaporator, into the front space part.

4. The refrigerator according to claim 3, wherein the cool air circulation fan comprises a cross flow fan.

5. The refrigerator according to claim 1, wherein the machine room comprises:

a machine room casing, having a housing mounted to the top of the cabinet to cover an upper surface and both side surfaces of the machine room, and a cover member hinged to the housing to open and close a front of the housing.

6. The refrigerator according to claim 5 wherein:

the cover member is provided with a plurality of vent holes.

7. The refrigerator according to claim 1, wherein the machine room comprises:

a cooling fan to cool the compressor and the condenser.

8. The refrigerator according to claim 1, wherein:

the top projection part is integrally formed with the cabinet.

9. A refrigerator, comprising:

a cabinet defining a freezer compartment and a refrigerator compartment therein, such that the freezer and refrigerator compartments are placed side-by-side with each other in the cabinet and partitioned from each other;

a top projection part formed by projecting rear portions of a top of the freezer and refrigerator compartments upward, the top projection part defining a first air cooling chamber in the freezer compartment and a second air cooling chamber in the refrigerator compartment therein, such that the first and second air cooling chambers extend upward as upper portions of the freezer and refrigerator compartments, respectively;

an air partition plate, each of the first and second air cooling chambers for the freezer and refrigerator compartments being partitioned into a front space part and a rear space part by the air path partition plate;

air suction guide members, mounted respectively to a rear surface of each of the freezer and refrigerator compartments, while being spaced apart from the rear surface of each of the freezer and refrigerator compartments, each air suction guide member having a plurality of air suction ports, thereby guiding air along an air suction path from each of the freezer and refrigerator compartments respectively, into the rear space part of each of the first and second air cooling chambers;

air exhaust guide members, mounted respectively to an upper surface of each of the freezer and refrigerator compartments while being spaced apart from the upper surface of each of the freezer and refrigerator compartments, each air exhaust guide member having a plurality of air exhaust ports, thereby uniformly discharging the cool air along an air exhaust path from the front space part of each of the first and second air cooling chambers respectively, into each of the freezer and refrigerator compartments; and a machine room defined on a top of the cabinet at a position in front of the top projection part, and having a compressor and a condenser therein, wherein each of the first and second air cooling chambers comprises an evaporator and a cool air circulation fan, each of the cool air circulation fans longitudinally extends in the respective air cooling chamber, and the respective air suction path and the respective air exhaust path extend laterally along the entire length of the refrigerator parallel to the rear surfaces of the refrigerator and freezer compartments and to communicate with the respective air cooling chamber.

10. The refrigerator according to claim 9, wherein each of the evaporators is installed in the rear space part of the corresponding first and second air cooling chambers.

11. The refrigerator according to claim 9, wherein the cool air circulation fan comprises:

a cross flow fan.

12. The refrigerator according to claim 9, wherein the cabinet comprises:

an inner casing;

an outer casing; and a thermal insulation material interposed between the inner and outer casings.

13. The refrigerator, according to claim 12, wherein the inner casing comprises:

two integrated bodies, respectively defining the freezer and refrigerator compartments.

14. The refrigerator according to claim 12, wherein the outer casing comprises:

two side panels that form two side surfaces of the cabinet;

two rear panels assembled with each other, and assembled with the two side panels, to form a rear surface of the cabinet;

a top panel to form a top surface of the cabinet; and a bottom panel to form a bottom surface of the cabinet.

15. The refrigerator according to claim 14, wherein:

first and second locking parts are positioned along facing edges of each of the two side panels and the two rear panels, respectively;

each first locking part has a longitudinal groove; and each second locking part has a longitudinal projection that locks in the longitudinal groove of the corresponding first locking part, to join the two rear panels, and join the two side panels to the two rear panels.

16. The refrigerator according to claim 14, wherein a grooved reinforcing part is longitudinally formed along at least one of the two rear panels, thus reinforcing the rear panels.

17. The refrigerator according to claim 14, wherein the top panel is stepped to form the top projection part.

18. The refrigerator according to claim 13, wherein the inner casing further comprises:

two chamber casings, the two chamber casings being produced separately from the two integrated bodies, and being installed at the rear portion of the top of the cabinet, such that the two chamber casings are respectively positioned above the freezer and refrigerator compartments, to define the first and second air cooling chambers.

19. A refrigerator, comprising:

a cabinet with a food storage compartment therein;

an air cooling chamber located at an upper rear portion of the food storage compartment, upwardly projected as a rear portion of the storage compartment;

an air suction path guiding air from the food storage compartment to the air cooling chamber;

an air exhaust path guiding air from the air cooling chamber to the food storage chamber;

an evaporator disposed in the air cooling chamber of the food storage compartment;

a cool air circulation fan disposed in the air cooling chamber of the food storage compartment; and a machine room, located on a top of the cabinet, and having a compressor and a condenser therein, wherein the cool air circulation fan longitudinally extends in the air cooling chamber, and the air suction path and the air exhaust path extend laterally alone the entire length of the refrigerator parallel to the upper rear portion of the storage compartment and to communicate with the air cooling chamber.

20. A refrigerator, comprising:

a cabinet with first and second food storage compartments therein;

first and second air cooling chambers located at respective upper portions of the first and second food storage compartments, upwardly projected as respective rear portions of the first and second storage compartments;

a machine room, located on a top of the cabinet, and having a compressor and a condenser therein;

a plurality of air suction paths guiding air from the respective food storage compartment to the respective air cooling chamber; and a plurality of air exhaust paths guiding air from the respective air cooling chamber to the respective food storage chamber;

wherein each of the first and second air cooling chambers of the first and second food storage compartments comprises an evaporator and a cool air circulation fan, wherein each of the cool air circulation fans longitudinally extends in the respective air cooling chamber, and the air suction path and the air exhaust path extend laterally along the entire length of the refrigerator parallel to the rear portions of the first and second storage compartments and to communicate with the respective air cooling chamber.

21. The refrigerator according to claim 20, wherein the first and second air cooling chambers are disposed horizontally in the upper portion of the storage compartment.

22. The refrigerator according to claim 20, wherein:

the first storage compartment is a freezer compartment; and the second storage compartment is a refrigerator compartment.

23. The refrigerator according to claim 20, wherein:

a flow of air past the cool air circulation fan is a laminar flow.

24. The refrigerator according to claim 20, wherein:

the cool air circulation fan is a cross flow fan.

25. The refrigerator according to claim 20, wherein the machine room comprises:

a cooling fan.

26. The refrigerator according to claim 20, wherein:

the machine room is located at a front portion of the cabinet.

27. The refrigerator according to claim 26, wherein:

atmospheric air circulates into the machine room.

28. The refrigerator according to claim 27, wherein:

atmospheric air circulates into the machine room from a front of the cabinet.

29. The refrigerator according to claim 25, wherein:

the cooling fan is disposed between the compressor and the condenser to cool the compressor and the condenser.

30. The refrigerator according to claim 22, wherein the cabinet comprises:

an inner casing;

an outer casing; and a thermal insulator interposed between the inner an outer casings.

31. The refrigerator according to claim 30, wherein:

the thermal insulator is a thermal insulation foam.

32. The refrigerator according to claim 30, wherein the inner casing comprises:

a first inner casing part defining the freezer compartment; and a second inner casing part defining the refrigerator compartment.

33. The refrigerator according to claim 32, wherein:

the first and second inner casing parts are integrally formed.

34. The refrigerator according to claim 30, wherein the outer casing comprises:

first and second side panels;

first and second rear panels;

a top panel; and a bottom panel.

35. The refrigerator according to claim 34, wherein a first joint where the first and second rear panels join comprises:

a first locking part with a longitudinal groove located on an edge of one of the first and second rear panels; and a second locking part with a longitudinal projection that corresponds to and engages the longitudinal groove of the first locking part, located on an edge of the other of the first and second rear panels.

36. The refrigerator according to claim 35, wherein a second joint where the first side panel joins the first rear panel comprises:

a first locking part with a longitudinal groove located on an edge of one of the first side panel and the first rear panel; and a second locking part with a longitudinal projection that corresponds to and engages the longitudinal groove of the first locking part, located on an edge of the other of the first side panel and the first rear panel.

37. The refrigerator according to claim 36, wherein a third joint where the second side panel joins the second rear panel comprises:

a first locking part with a longitudinal groove located on an edge of one of the second side panel and the second rear panel; and a second locking part with a longitudinal projection that corresponds to and engages the longitudinal groove of the first locking part, located on an edge of the second side panel and the second rear panel.

38. The refrigerator according to claim 34, wherein:

a grooved reinforcing part is located on at least one of the first and second rear panels to reinforce the rear panels.

39. The refrigerator according to claim 32, wherein:

the first inner casing part comprises a first chamber casing defining the first air cooling chamber; and the second inner casing part comprises a second chamber casing defining the second air cooling chamber.

40. The refrigerator according to claim 39, wherein:

the first and second chamber casings are integrally formed with the first and second inner casing parts, respectively.

41. A refrigerator, comprising:

a cabinet defining a plurality of food storage compartments therein;

a plurality of air cooling chambers located within respective upwardly projected portions of upper rear portions of the food storage compartments, each having an evaporator and a cool air circulation fan;

a plurality of air suction paths guiding air from the respective food storage compartment to the respective air cooling chamber;

a plurality of air exhaust paths guiding air from the respective air cooling chamber to the respective food storage chamber; and a machine room located at a front portion on top of the cabinet, wherein each of the cool air circulation fans longitudinally extends in the respective air cooling chamber, and the air suction path and the air exhaust path extend laterally along the entire length of the refrigerator parallel to the upper rear portions of the food storage compartments and to communicate with the respective air cooling chamber.

* * * * *

UNITED STATES PATENT AND TRADEMARK OFFICE

CERTIFICATE OF CORRECTION

PATENT NO. : 7,185,509 B2
APPLICATION NO. : 10/644937
DATED : March 6, 2007
INVENTOR(S) : Jae Seung Lee et al.

It is certified that error appears in the above-identified patent and that said Letters Patent is hereby corrected as shown below:

Title Page, Column 2 (Primary Examiner), Line 1, change "William C. Doerrier" to --William C. Doerrler--.

Column 8, Line 48, change "about" to --above--.

Column 8, Line 62, after "claim 5" insert --,--.

Column 10, Line 52, after "laterally" change "alone" to --along--.

Column 10, Line 53, before "rear" delete "upper".

Column 12, Line 27, before "second" insert --other of the--.

Signed and Sealed this

Twenty-sixth Day of June, 2007

JON W. DUDAS
*Director of the United States Patent and Trademark Office*